US005370806A

United States Patent [19]

Cardis et al.

[11] Patent Number: 5,370,806

[45] Date of Patent: Dec. 6, 1994

[54] BORATED DIHYDROCARBYL DITHIOCARBAMATE LUBRICANT ADDITIVES AND COMPOSITION THEREOF

[75] Inventors: Angeline B. Cardis, Florence; Liehpao O. Farng, Lawrenceville; Andrew G. Horodysky, Cherry Hill; Abraham O. M. Okorodudu, West Deptford, all of N.J.

[73] Assignee: Mobil Oil Corporation, Fairfax, Va.

[21] Appl. No.: 454,537

[22] Filed: Dec. 21, 1989

[51] Int. Cl.[5] ..... C10M 139/00; C10M 135/18

[52] U.S. Cl. ..... 252/46.3; 558/236; 558/286; 558/293; 558/295

[58] Field of Search ..... 558/286, 293, 295, 236; 252/49.6, 33.6, 47.5, 46.3, 400.4, 400.41; 44/317

[56] References Cited

U.S. PATENT DOCUMENTS

| | | | |
|---|---|---|---|
| 2,504,672 | 4/1950 | Farrington et al. | 252/47.5 |
| 2,673,839 | 11/1954 | Kirshenbaum | 558/240 |
| 2,756,249 | 7/1956 | Kirshenbaum et al. | 252/47.5 |
| 3,081,335 | 3/1963 | Morris et al. | 252/47.5 |
| 3,833,496 | 9/1974 | Malec | 252/33.6 |
| 4,110,319 | 8/1978 | Lawrence | 558/240 |
| 4,225,450 | 9/1980 | Rosenberger | 252/47.5 |
| 4,226,732 | 10/1980 | Reinhard et al. | 252/47.5 |
| 4,360,438 | 11/1982 | Rowan et al. | 252/47.5 |
| 4,524,005 | 6/1985 | Horodysky | 558/293 |
| 4,529,529 | 7/1985 | Horodysky | 558/293 |
| 4,609,480 | 9/1986 | Hata et al. | 252/47.5 |
| 4,648,985 | 3/1987 | Thorsell | 252/32.7 E |
| 4,756,842 | 7/1988 | Holstedt | 252/46.3 |
| 4,759,873 | 7/1988 | Audeh | 252/49.6 |
| 4,788,340 | 11/1988 | Horodysky | 252/293 |
| 4,859,353 | 8/1989 | Colclough | 558/293 |
| 4,997,969 | 3/1991 | Luciani | 252/47.5 |
| 5,126,063 | 6/1992 | Cardis | 252/46.3 |

*Primary Examiner*—Margaret Medley
*Attorney, Agent, or Firm*—Alexander J. McKillop; Malcolm D. Keen; Charles A. Malone

[57] ABSTRACT

Borated dihydrocarbyl dithiocarbamate reaction products have been found to be effective antioxidant/antiwear multifunctional additives for lubricants.

20 Claims, No Drawings

BORATED DIHYDROCARBYL DITHIOCARBAMATE LUBRICANT ADDITIVES AND COMPOSITION THEREOF

BACKGROUND OF THE INVENTION

This invention relates to multifunctional antioxidant-/antiwear additives and to compositions comprising lubricants, greases and other solid lubricants thereof containing a minor amount of mixed alcohol/dithiocarbamate derived borate.

The metal surfaces of machinery or engines operate under heavy or normal loads wherein the metal is under friction, even when being lubricated. Thus, there is always metal wear which in some cases can be excessive. It is clear that lubricants used to protect the metal surfaces do not completely prevent wear at the points of metal to metal contact. Consequently, the performance of the machine or engine will suffer, and in aggravated cases the machine or engine may be become completely inoperative from the wear caused by the friction and the load.

There have been many attempts to devise additive systems to improve the extreme pressure/load carrying properties of a lubricant. The non-metallic derivatives of the present invention provide lubricating oil compositions with enhanced antioxidant/antiwear and extreme pressure/load carrying characteristics and are believed to be capable of overcoming some of the aforementioned deficiencies of prior art additives.

Lubricants, such as lubricating oils and greases, are subject to oxidative deterioration at elevated temperatures or upon prolonged exposure to the elements. Such deterioration is evidenced, in many instances, by an increase in acidity and in viscosity, and when the deterioration is severe enough, it can cause metal parts to corrode. Additionally, severe oxidation leads to a loss of lubrication properties, and in especially severe cases this may cause complete breakdown of the device being lubricated. Many additives have been tried, however, many of them are only marginally effective except at high concentrations. Improved antioxidants are clearly needed.

Antioxidants or oxidation inhibitors are used to minimize the effects of oil deterioration that occur when, for example, hot oil is contacted with air. The degree and rate of oxidation will depend on temperature, air and oil flow rates and, of particular importance, on the presence of metals that may catalytically promote oxidation. Antioxidants generally function by prevention of chain peroxide reaction and/or metal catalyst deactivation. They prevent the formation of acid sludges, darkening of the oil and increases in viscosity due to the formation of polymeric materials.

Water (moisture) is another critical problem. In spite of even extraordinary precautionary efforts water is found as a film or in minute droplets in vessels containing various hydrocarbon distillates. This brings about ideal conditions for corrosion and damage of metal surfaces of the vessels and the materials contained therein. Also in the lubrication of internal combustion engines, for example, quantities of water are often present as a separate phase within the lubricating system. Another serious problem in respect to metallic surfaces in contact with adjacent metallic surfaces is the surface wear caused by the contact of such surfaces. One material capable of simultaneously coping with such problems effectively is highly desireous.

The use of metal dithiocarbamates (such as zinc, nickel, or lead dialkyl dithiocarbamates) are known as effective antioxidants and antiozonants for many rubbers and polymers in various kinds of applications, such as SBR and NBR.

The non-metallic (ashless) dithiocarbamates, such as 4,4'-methylene bis(dibutyl dithiocarbamate), have been well known for their antioxidant and extreme pressure properties in lubricant applications.

The use of borate has been widely reported as having beneficial multifunctional friction reducing properties, as well as antioxidant properties in lubricant applications.

It has now been found that the use of these alcohol or hydroxy-hydrocarbyl/dithiocarbamate-derived hydroxy borates provides exceptional antioxidant and antiwear/EP activity with potential antifatigue and high temperature stabilizing properties.

SUMMARY OF THE INVENTION

This application is therefore directed to lubricant compositions containing small additive concentrations of mixed alcohol/S-hydroxyalkyl N,N-dihydrocarbyl dithiocarbamate-derived borates which possess excellent antioxidant properties coupled with very good antiwear and extreme pressure load carrying activities. Both the dithiocarbamate moiety and the borate moiety are believed to provide the basis for the synergistic antioxidant activity. The dithiocarbamate group is also believed to contribute significant antiwear property to these novel additives.

All of these beneficial properties are believed to be enhanced as a result of this novel internal synergism. This unique internal synergism concept is believed to be applicable to similar structures containing (a) dithiocarbamate groups, (b) borate groups within the same molecule. The products of this patent information show good stability and compatibility when used in the presence of other commonly used additives in lubricant compositions.

The lubricant compositions described herein are believed to be novel and their use as antioxidant/antiwear and extreme pressure/load carrying lubricant additives is also believed to be novel.

DESCRIPTION OF SPECIFIC EMBODIMENTS

Metallic, e.g., sodium dialkyl dithiocarbamates may be synthesized by reacting equal molar amounts of metallic hydroxide such as sodium or potassium hydroxide or the like, a secondary dialkyl amine, and carbon disulfide in aqueous media or organic solution depending on conditions (Equation 1).

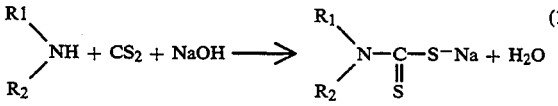

(1)

Similarly, triethylammonium salts of dithiocarbamates can be made by reacting triethylamine, dialkylamine and carbon disulfide in the non-aqueous media (Equation 2).

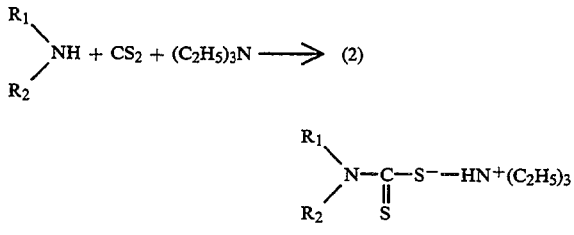

This structure is more generally represented as

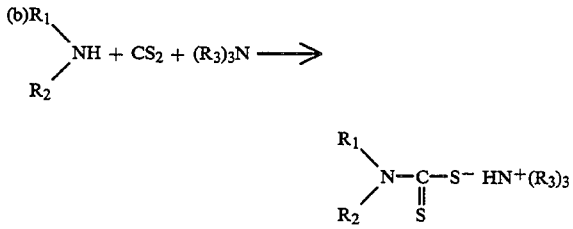

where $R_1$, $R_2$ are $C_1$ to about $C_{60}$ hydrocarbyl, $R_3$ is $C_1$ to about $C_{50}$ hydrocarbyl and M is a metal cation.

Propylene oxide (1,2-epoxypropane) was reacted with either sodium dialkyl dithiocarbamates or triethylammonium salts of dialkyl dithiocarbamates to form S-hydroxypropyl N,N-dialkyl dithiocarbamates as generally described in Equation 3.

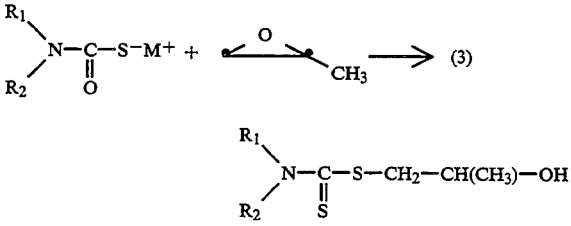

Where $R_1$, $R_2$ are hydrogen, or $C_1$ to $C_{60}$ hydrocarbyl.

$M^+$ represents the cationic moiety of dithiocarbamate salt, such as sodium ion ($Na^+$) or potassim ion ($K^+$), triethylammonium ion $[(C_2H_5)_3N^+H]$, or other suitable cations such as transition metal ions.

Other epoxides with general structure below are also available for these types of reactions.

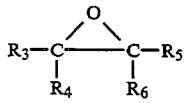

Where $R_3$, $R_4$, $R_5$ and $R_6$ are hydrogen, or $C_1$ to $C_{30}$ hydrocarbyl, and optionally can contain additional sulfur, nitrogen and/or oxygen.

Alternatively, halohydrins (such as chlorohydrin) may be used to react with either sodium dialkyl dithiocarbamates or triethylammonium salts of dialkyl dithiocarbamates to form S-hydroxylalkyl N,N-dialkyl dithiocarbamates as generally described in Equation 4.

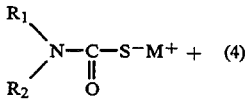

-continued

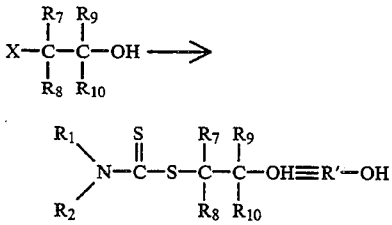

Where $R_7$, $R_8$, $R_9$ and $R_{10}$ are hydrogen, or $C_1$ to $C_{60}$ hydrocarbyl, R' represents the general dithiocarbamate-derived S-hydrocarbyl moiety, and X is halide (Cl, Br, I).

An excess of one reagent or another can be used. However, the most promising stoichiometry is approximately one mole of dithiocarbamate salts to one mole of halohydrins or epoxides. An excess of up to 5–10 moles of epoxides can on occasion be beneficial. Accordingly, equimolar, less than molar or more than molar quantities of reactants can be used. The reactions of equations (1), (2) or (3) generally take place at temperatures varying from about 0° to 150° C. or at ambient temperature and pressures for periods of time of up to 12 hours or more. Slightly higher pressures may be used if desired.

Subsequently, the S-hydroxylalkyl dihydrocarbyl dithiocarbamates were coborated with hydrocarbyl alcohols in the presence of boronating agents (Equation 5).

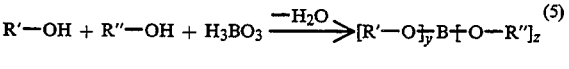

and other polymeric structures, where y and z are integers from 0 to 3, y+z=3 and where R' represents the dithiocarbamate derived S-hydrocarbyl moiety and R'' is $C_1$ to $C_{100}$ hydrocarbyl, or sulfur, nitrogen and/or oxygen or boron containing $C_1$ to $C_{100}$ hydrocarbyl. One example is that R''-OH can be an ethoxylated alkyl hydroxy compound (I) or hydroxyesters (II) or (III),

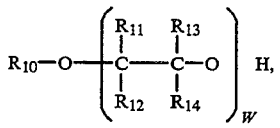

(I)

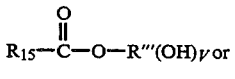

(II)

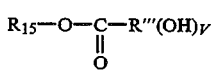

(III)

where R''' is $C_1$ to $C_{100}$ hydrocarbyl or sulfur, nitrogen and/or oxygen containing $C_1$ to $C_{100}$ hydrocarbyl, and where $R_{10}$ is $C_1$ to $C_{60}$ hydrocarbyl, $R_{11}$, $R_{12}$, $R_{13}$ and $R_{14}$ are hydrogen, or $C_1$ to $C_{60}$ hydrocarbyl, $R_{15}$ is $C_3$–$C_{30}$ hydrocarbyl, W is 1 to 20 and V is 1 to 6.

When boronating (borating) an excess of one reagent or another can be used. Molar quantities, less than molar quantities or more than molar quantities of a boronating agent can be used. Accordingly, stoichiometric amounts of the boronating agent or up to 100% excess can be advantageously used. Boric acid, metaborates, trialkyl borates, borate esters, or any other suitable boronatng agent may be employed. If a solvent is used the temperature of reaction will vary accordingly. Usually atmospheric or ambient pressure is used, however, higher or lower pressures may be use if desired. The time of reaction for boronating is not critical but will, or course, vary primarily with the temperature and pressure etc. used.

The base lubricants which are useful with the additives of this invention may be any oil of lubricating viscosity, whether natural, i.e., mineral, or synthetic.

The additives may be therefore incorporated into any suitable lubricating media which comprises oils of lubricating viscosity, e.g., mineral or synthetic; or mixtures of mineral and synthetic or greases in which the aforementioned oils are employed as a vehicle or into such functional fluids as hydraulic fluids, brake fluids, power transmission fluids and the like. In general, mineral oils and/or synthetic, employed as the lubricant oil, or grease vehicle may be of any suitable lubricating visocosity range, as for example, from about 45 SSU at 100° F. to about 6000 SSU at 100° F., and, preferably, from about 50 to about 250 SSU at 210° F. These oils may have viscosity indices from about 70 to about 95 preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent and other additives components to be included in the grease formulation.

In instances where synthetic oil, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, etc.

Fully formulated lubricating oils may include a variety of additives (for their known purpose) such as dispersants, detergents, inhibitors, antiwear agents, antioxidant, antifoam, pour depressant and other additives including phenates, sulfonates and zinc dithiophosphates. As hereinbefore indicated, the aforementioned additive compounds may be incorporated as multifunctional agents in grease compositions. When high temperature stability is not a requirement of the finished grease, mineral oils having a viscosity of at least 40 SSU at 150° F., and particularly those falling within the range from about 60 SSU to about 6,000 SSU at 100° F. may be employed. The lubricating vehicles of the improved greases of the present invention, containing the above described additives, are combined with a grease forming quantity of a thickening agent. For this purpose, a wide variety of materials dispersed in the lubricating vehicle in grease-forming quantities in such degree as to impart to the resulting grease composition the desired consistency. Exemplary of the thickening agents that may be employed in the grease formulation are non-soap thickeners, such as surface-modified clays and silicas, aryl ureas, calcium complexes and similar materials. In general, grease thickeners may be employed which do not melt and dissolve when used at the required temperature within a particular environment; soap thickeners such as metallic (lithium or calcium) soaps including hydroxy stearate and/or stearate soaps can be used however, in all other respects, any material which is normally employed for thickening or gelling hydrocarbon fluids or forming greases can be used in preparing the aforementioned improved greases in accordance with the present invention.

Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

The entire amount of thickener need not be derived from the aforementioned preferred members significant benefit can be attained using as little thereof as about 15% by weight of the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These included soaps of stearic and oleic acids.

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate-and high-molecular weight acids and of nut oil acids.

As has been disclosed hereinabove, the reaction products are useful as multifunctional antioxidant/antiwear-/extreme pressure agents. They are added to the lubricating medium in amounts sufficient to impart such properties to the lubricant. More particularly, such properties will be imparted to the lubricant by adding from about 0.01% to about 10% by weight, preferably from about 0.01% to about 3%, of the neat product.

Having described the invention in general terms, the following specific examples are offered for purposes of illustration no intention to limit the invention thereby is to be inferred therefrom.

EXAMPLE 1

S-2-Hydroxypropyl N,N-di-2-Ethylhexyl Dithiocarbamate

Approximately 483 g (2.0 moles) of bis-2-ethylhexylamine and 204 g (2.02 moles) of triethylamine were mixed together in a two-liter, four-neck reactor equipped with thermometer, dropping funnel, Dean Stark trap, condenser and agitator. Slowly, 160 g (2.1 moles) of carbon disulfide was added dropwise through the dropping funnel at 15°-30° C. over a course of 1.5 hours. Shortly after the completion of carbon disulfide addition, approximately 118 g (2.03 moles) of propylene oxide was slowly added to the reactor at 15°-25° C. over a course of one hour. The reaction exotherm was controlled by using ice-water bath for cooling. It was further stirred for two hours at ambient temperature upon the completion of propylene oxide addition. Thereafter, triethylamine was removed by vacuum distillation at 90°-110° C. The final residue is a viscous, yellowish fluid weighing 748.6 g.

EXAMPLE 2

S-2-Hydroxypropyl N,N-Dibutyl Dithiocarbamate

Approximately 516 g (4.0 moles) of dibutylamine and 405 g (4.0 moles) of triethylamine were mixed together in a three-liter reactor. Approximately 320 g (4.21 moles) of carbon disulfide was added dropwise to the reactor over a course of three hours. at temperature about 35° C. Upon the completion of carbon disulfide addition, about 235 g (4.045 moles) of propylene oxide was subsequently added over a course of two hours at ambient temperature (about 30° C.). Thereafter, the resulting yellow liquid was stirred temperature for three days under a nitrogen blanket. Finally, triethylamine was vacuum distilled at 100°-110° C. to produce a viscous, reddish liquid as the desired product (1075 g).

EXAMPLE 3

2-Ethylhexanol/S-2-Hydroxypropyl N,N-di-2-ethylhexyl Dithiocarbamate Mixed Borates Approximately 100 g of the above product of Example 1, 50 g of 2-ethyl-1-hexanol, 50 g boric acid, and 100 g toluene were mixed together in a one-liter, four-neck reactor equipped with thermometer, $N_2$ sparget, Dean Stark trap condenser and agitator. This mixture was heated at 80°-85° C. for two hours, and then the reaction temperature was gradually increased up to boiling toluene at 112°±2° C. over a course of three hours. A catalytic amount of Sag 47 defoamant was added to reduce the formation of foaming material, and about 150 g mineral oil diluent was added for easy handling. A total amount of 21.4 ml of water was collected in the Dean Stark trap.

An additional hour of heating produced no more water of reaction. The toluene was subsequently removed by distillation to produce a dark brownish fluid as desired product.

EXAMPLE 4

2-Butanol/S-2-Hydroxypropyl N,N-Dibutyl Dithiocarbamate Mixed Borates

Approximately 100 g of the above product of Example 2, 50 g of 2-butanol, 50 g boric acid, and 100 g toluene were reacted at 80°-115° C. over a course of six hours. A total amount of 29 ml of water was collected in the Dean Stark trap. The volatiles were vacuum distilled until water evolution ceased. The final product was a viscous, yellow fluid.

The mixed borates (Examples 3 and 4) were blended into fully formulated mineral oils and evaluated for antioxidant performance by Method M334-2, Catalytic Oxidation Test at 325° F. for 40 hours (Table 1); Method M334-3, Cataytic Oxidation Test at 325° F. for 72 hours (Table 2).

The Catalytic Oxidation Test may be summarized as follows.

The test lubricant composition is subjected to a stream of air which is bubbled through the composition at a rate of 5 liters per hour. Present in the composition are metals commonly used as materials of engine construction, namely:

(a) 15.6 sq. in. of sand-blasted iron wire,
(b) 0.78 sq. in. of polished copper wire.
(c) 0.87 sq. in. of polished aluminum wire, and
(d) 0.167 sq. in. of polished lead surface.

Inhibitors for oil are rated on the basis of prevention of oil deterioration as measured by the increase in acid formation or neutralization number (NN) and kinematic viscosity (KV) occasioned by the oxidation.

TABLE 1

| | Catalytic Oxidation Test (M334-2) 40 Hours at 325° F. | | | |
|---|---|---|---|---|
| Item | Additive Conc. (wt %) | Percent Change In Viscosity Δ KV | Change In Acid Number Δ NN | Lead Loss |
| Base Oil (200 second solvent refined paraffinic neutral, mineral oil) | — | 57.9 | 4.78 | 2.9 |
| Example 3 | 1.0 | 13.6 | 2.10 | 0.2 |
| Example 4 | 1.0 | 5.1 | 0.08 | 0.4 |

TABLE 2

| | Catalytic Oxidation Test (M334-3) 72 Hours at 325° F. | | | |
|---|---|---|---|---|
| Item | Additive Conc. (wt %) | Percent Change In Viscosity Δ KV | Change In Acid Number Δ NN | Lead Loss |
| Base Oil (200 second solvent refined paraffinic neutral, mineral oil) | — | 99.4 | 8.53 | 5.2 |
| Example 4 | 1.0 | 12.1 | 0.30 | 0.0 |

As shown above, the products of this invention show very good antioxidant activity as evidenced by control of increase in acidity, viscosity and lead loss.

The dithiocarbamate-derived borates were also evaluated for antiwear performance using the Four-Ball Test (Table 3).

The Four Ball Wear Test, for example, disclosed in U.S. Pat. No. 3,423,316. In general, in this test three steel balls of SAE 52100 steel are held in a ball cup. A fourth ball positioned on a rotable vertical axis is brought into contact with the three balls and is rotated against them. The force with which the fourth is held against the three stationary balls may be varied according to a desired load. The test lubricant is added to the ball cup and acts as a lubricant for the rotation. At the end of the test, the steel balls are investigated for wear scars; the extent of scarring represents the effectiveness of the lubricant as an antiwear agent. Results are also reported as wear rates in volume of wear per unt sliding distance per kilogram load. The lower the wear rate, the more effective the lubricant as an antiwear agent.

TABLE 3

| Four Ball Test | |
|---|---|
| Item | Wear Scar Diameter in MM (60 Kg Load, 30 Minute, 2000 rpm and 200° F.) |
| Base Oil (80% Solvent Paraffinic Bright, 20% Solvent Paraffinic Neutral Minerals Oils) | 4.37 |
| 1% Example 3 in above Base Oil | 0.96 |
| 1% Example 4 in above Base Oil | 1.12 |

As can be seen from the above wear test results, the products described exhibit considerable antiwear acitivity.

The dithiocarbamate-derived borates were also evaluated for copper corrosion characteristics (Table 3). The Copper Corrosion Test employed for this purpose was a standard ASTM Test D-130 which, in general, comprises immersion of a polished copper strip in the material to be tested for a period of 3 hours at a temperature of 250° F. At the end of this period the copper strip is removed, washed, and rated for degree of corrosion by comparison with the ASTM standard strips. Test data is reported in Table 3. The concentration of the respective examples is in Wt. % in 200" SPN, i.e., 200 second solvent paraffinic neutral.

TABLE 4

| Copper Strip Corrosivity (250° F., 3 Hours) | | |
|---|---|---|
| Item | Additive Conc. (wt %) | Corrosivity Rating |
| Base Oil (200 Second, Solvent Refined, Paraffinic Neutral, Mineral Oil) | — | 1A |
| Example 3 | 1.0 | 1A |
| Example 4 | 1.0 | 1A |

As shown above, the products of this invention show very good antioxidant activity as evidenced by control of increase in acidity and viscosity, and the products are non-corrosive to copper metal.

The use of additive concentrations of mixed alcohol/-dithiocarbamate-derived hydroxy borates in premium quality automotive and industrial lubricants will significantly enhance the stability, reduce the wear, and extend the service life. These novel compositions described in this application are useful at low concentrations and do not contain any potentially undesirable metals, phosphorus, or chloride, and do not cause any corrosivity problem. These multifunctional antioxidant-/antiwear additives can be commercially made using an economically favorable process which can be readily implemented using known technology in existing equipment.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A lubricant composition comprising a major amount of a lubricating oil or grease and a minor amount of a multifunctional antioxidant antiwear, extreme pressure borated dihydrocarbyl dithiocarbamate reaction product having the structural formula:

$$[R'-O]_y-B-[O-R'']_z$$

where R' is the dithiocarbamate, R'' is $C_1$ To $C_{100}$ hydrocarbyl, said hydrocarbyl group optionally containing at least one heteroatom selected from a member of the group consisting of sulfer, nitrogen, oxygen or boron, y+z are integers and the sum of y+z=3, prepared by (1) reacting an alkali metal hydroxide or trihydrocarbyl amine, a dihydrocarbyl amine and carbon disulfide wherein said first step comprises the reaction having the structural formulas:

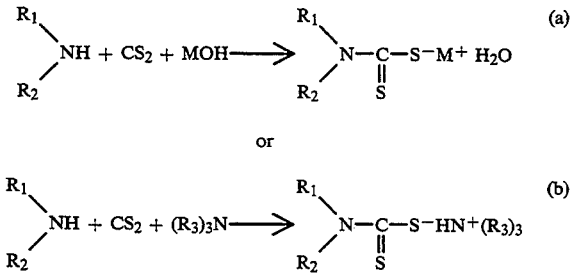

where $R_1$ and $R_2$ are $C_1$ to about $C_{60}$ hydrocarbyl and $R_3$ is $C_1$ to about $C_{50}$ hydrocarbyl and M is a metal cation and (2) reacting the product of (1) with a hydrocarbyl oxide thereby forming S-hydroxyhydrocarbyl dihydrocarbyl dithiocarbamates wherein said second step comprises the reaction structural formulas:

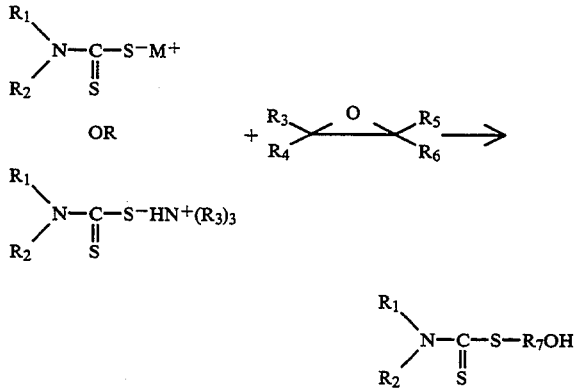

where $R_1$, $R_2$ are $C_1$ to $C_{60}$ hydrocarbyl, where $R_3$, $R_4$, $R_5$ and $R_6$ are hydrogen or $C_1$ to about $C_{30}$ hydrocarbyl optionally containing sulfur, nitrogen and/or oxygen, $R_7$ is the hydrocarbyl moiety derived from said oxide and where $M^+$ is the cationic moiety of a dithiocarbamate salt and (3) there after coborating the product of (2) with a $C_1$–$C_{100}$ hydrocarbyl alcohol in the presence of a borating agent wherein the reaction temperatures vary from 0° to about 150° C., the molar ratios of reactants vary from equimolar to less than molar to more than molar under ambient pressures.

2. The composition of claim 1 wherein the borating agent is selected from the group consisting of boric acid, metaborates, or trialkyl borates.

3. The composition of claim 2 wherein the borating agent is boric acid.

4. The composition of claim 2 wherein said reaction product is 2-ethylhexanol/S-2-hydroxypropyl N,N-di-2-ethylhexyl dithiocarbamate borate.

5. The composition of claim 2 wherein said reaction product is 2-butanol/S-2-hydroxypropyl N,N-dibutyl dithiocarbamate borate.

6. The lubricant composition of claim 1 wherein the lubricating oil is selected from the group consisting of (1) mineral oils, (2) synthetic oils, (3) mixtures of mineral and synthetic oils or (4) a grease prepared from (1), (2) or (3).

7. The lubricant composition of claim 6 wherein the oil is (1) a mineral oil.

8. The lubricant composition of claim 6 wherein the oil is (2) a synthetic oil.

9. The lubricant composition of claim 6 wherein the oil is (3) a mixture of mineral and synthetic oils.

10. The lubricant composition of claim 6 wherein said composition is (4) a grease.

11. The lubricant composition of claim 6 comprising from about 0.01 to about 10 wt % of said borated reaction product.

12. The composition of claim 11 comprising from about 0.01 wt % to about 3 wt % of said borated reaction product.

13. A process of preparing a borated dihydrocarbyl dithiocarbyl dithiocarbamate reaction product having the structural formula:

$$[R'-O]_y-B-[O-R'']_z$$

where R' is the dithiocarbamate, R'' is $C_1$ to $C_{100}$ hydrocarbyl, said hydrocarbyl group optionally containing at least one heteroatom selected from a member of the group consisting of sulfur, nitrogen, oxygen or boron, y+z are integers and the sum of y+z=3,comprising (1) reacting an alkali metal hydroxide or a trihydrocarbyl amine, a dihydrocarbylamine and carbon disulfide in non-aqueous media wherein said first step comprises the reaction having the structural formulas:

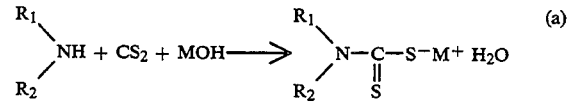

(a)

or

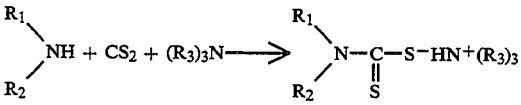

(b)

where $R_1$ and $R_2$ are $C_1$ to about $C_{60}$ hydrocarbyl and $R_3$ is $C_1$ to about $C_{50}$ hydrocarbyl and M is a metal cation and (2) reacting the product of (1) with a hydrocarbyl oxide to form a hydroxyhydrocarbyl N,N-dihydrocarbyl dithiocarbamate wherein said second step comprises the reaction structural formulas:

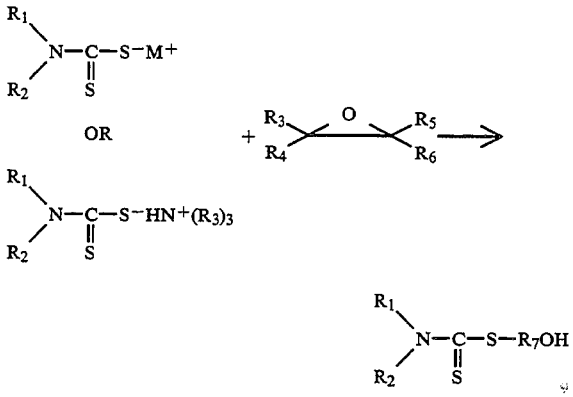

where $R_1$, $R_2$ are $C_1$ to $C_{60}$ hydrocarbyl, where $R_3$, $R_4$, $R_5$ and $R_6$ are hydrogen or $C_1$ to about $C_{30}$ hydrocarbyl optionally containing sulfur, nitrogen and/or oxygen, $R_7$ is the hydrocarbyl moiety derived from said oxide and where $M^+$ is the cationic moiety of a dithiocarbamate salt and (3) thereafter coborating the resultant product of (2) with $C_1$–$C_{100}$ hydrocarbyl alcohol in the presence of a borating agent wherein the reaction temperatures vary from 0° to about 150° C., the molar ratios of reactants vary from equimolar to less than molar to more than molar under ambient pressure.

14. The process of claim 13 wherein said alkali metal ion is $Na^+$ and said trialkylammonium cation is triethylammonium ion.

15. The process of claim 13 wherein the desired reaction product is 2-butanol/S-2-hydroxypropyl N,N-butyl dithiocarbamate borates.

16. The process of claim 13 wherein the desired reaction product is 2-ethylhexanol/S-2-hydroxypropyl N,N-di-2-ethylhexyl dithiocarbamate borates.

17. The process of claim 13 wherein the boronating agent is selected from boric acid, metaborates, or trialkyl borates.

18. The process of claim 17 wherein the boronating agent is boric acid.

19. The process of claim 17 wherein the boronating agent is a metaborate.

20. The process of claim 17 wherein the boronating agent is a trialkyl borate.

* * * * *